US006065194A

United States Patent [19]

Dilo

[11] Patent Number: 6,065,194

[45] Date of Patent: May 23, 2000

[54] APPARATUS FOR NEEDLING A FIBER FLEECE WEB

[75] Inventor: Johann Philipp Dilo, Eberbach, Germany

[73] Assignee: Oskar Dilo Maschinenfabrik KG, Germany

[21] Appl. No.: 09/311,259

[22] Filed: May 13, 1999

[30] Foreign Application Priority Data

May 20, 1998 [DE] Germany ..... 198 22 725

[51] Int. Cl.[7] ..... D04H 18/00

[52] U.S. Cl. ..... 28/107; 28/113

[58] Field of Search ..... 28/107, 109, 110, 28/111, 113, 114, 115

[56] References Cited

U.S. PATENT DOCUMENTS

| | | | |
|---|---|---|---|
| 3,909,891 | 10/1975 | Dilo | 28/111 |
| 4,384,393 | 5/1983 | Asselin | 28/107 |
| 5,390,556 | 2/1995 | Nencini et al. | 28/113 |
| 5,548,881 | 8/1996 | Ludwig | 28/114 |
| 5,732,453 | 3/1998 | Dilo et al. | 28/114 |
| 5,873,152 | 2/1999 | Jourde et al. | 28/107 |

FOREIGN PATENT DOCUMENTS

| | | |
|---|---|---|
| 1 803 342 | 5/1970 | Germany . |
| 2 202 127 | 7/1973 | Germany . |
| 0 151 775 | 4/1981 | Germany . |
| 19615697 A1 | 3/1997 | Germany . |

*Primary Examiner*—Amy B. Vanatta
*Attorney, Agent, or Firm*—Morgan & Finnegan, L.L.P.

[57] ABSTRACT

An apparatus for needling a fiber fleece web has a plurality of needle bars, the drive means thereof being individually associated to the individual needle bars or a group of closely adjoining needle bars which belong to one of a plurality of needling zones, and wherein said drive means are connected to a common control means which enables an individual control of the movement of the needle bars or needle bar groups. The needle bars or needle bar groups can in particular be moved in three directions orthogonal with respect to one another, and the needles can possibly be supported rotatably, and can perform a controlled rotary movement during the stitching movement.

65 Claims, 3 Drawing Sheets

APPARATUS FOR NEEDLING A FIBER FLEECE WEB

FIELD OF THE INVENTION

The present invention relates to an apparatus for needling a fiber fleece web, comprising a fleece support, through which the fiber fleece web is moved by a transport means in a transport direction, a stripper arranged at a spacing above the fleece support, said stripper having a plurality of needle penetration holes, and a needling unit with at least two needle bars extending transversely to the fleece transport direction and on the side of the stripper opposite the fleece support, and said needle bars each carrying on their side facing the stripper a needle board equipped with a plurality of needles, and drive means providing the needle bars in an oscillating stitching movement in a direction perpendicular to the fleece support.

DISCUSSION OF THE PRIOR ART

An apparatus of the aforementioned kind is known from U.S. Pat. No. 5,732,453 to Dilo et al. That patent describes a needling machine, in which two needling bars arranged behind one another in a fiber fleece transport direction are subjected to a reciprocating movement by a common drive, said movement being directed perpendicular to the fiber fleece support. Furthermore, a second drive may set the needle bars in a reciprocating movement extending in parallel to the fiber fleece transport direction so that by the superposition of these movements the needle bars can be set in a motion which, depending on the height of the movement strokes is circular or more or less elliptical.

A needle machine is described in co-pending U.S. patent application Ser. No. 09/098,245 filed by Dilo et al. on Jun. 17, 1998, in which two rigidly coupled needle bars may be subjected to a third movement component in addition to the two movement components described in U.S. Pat. No. 5,732,453, said third movement component extending perpendicular to the needle stitching direction and perpendicular to the fleece transport direction, thus further influencing the stitching pattern.

These needle machines have in common that the needle bars are rigidly coupled to each other and their movements can therefore not be influenced individually.

A needle machine for manufacturing pole fleeces is known from DE-OS 2 308 516, which comprises three needling zones arranged behind one another in the fleece transport direction, in which the fleece is needled from both sides. The needle bars of one side are set in the stitching motion via drive belts of a common drive, so that an individual influence of the needle bar movement is also not possible in this needle machine.

A needle machine is known from DE 693 04 208 T2, by means of which a fiber fleece can be needled from both sides. The needle bars comprise individual drive means which drive the needle bars in a coordinated manner. By means of control devices, the motors of these drive means can be coordinated with regard to the angle of rotation position. The needle boards of this needle machine carry a plurality of needle rows, which makes it impossible to individually take the progressing state of material processing along the fleece transport path into account.

SUMMARY OF THE INVENTION

The object of the invention is to provide an apparatus of the above-mentioned kind which ensures the highest possible measure of individual processing alternatives of a fiber fleece web at the individual needling zones.

The invention provides that each needle bar, or a group of closely adjacent needle bars belonging to one of a plurality of needling zones, comprises an individual drive means, and all drive means can be controlled independently from one another. If the needle bar is not only driven in the needle stitching direction but also in parallel to the fleece plane in parallel and transversely to the fiber fleece web transport direction, these respective drive means according to the invention are also individually associated to the respective needle bar or the needle bar group, so that the movement components resulting therefrom and extending transversely to the stitching direction may be influenced individually in the needle bar or the needle bar group.

Thus, the needle bars or needle bar groups may be moved individually in three directions orthogonal with respect to each other, and according to a development of the invention it is provided to also set the needles in motion around their axis. It is then possible in an especially simple manner to produce fiber patterns on the fleece that are similar to lock stitches. Four drive means are then associated to each individual needle bar: The first drive means sets the needle bar in stitching motion, the second drive means generates an oscillating motion component extending in parallel to the fleece transport direction. It is possible by the second motion component to increase the transport velocity of the fleece, since in case of an appropriate time coordination of the motion component caused by the second drive means, the needles in the state stitched-in into the fleece follow the fleece web transport direction. The third drive means displaces the needles transversely to the fleece transport direction, whereby the stitching pattern can be influenced to avoid for instance the generation of stripes in the fiber fleece. The fourth drive means sets the needles in rotation, wherein this rotation may be unidirectional or forth and back.

The movement of rotation may be programmed, infinitely variable at an angle of 0° up to a multiple of 360°, or it may be adjusted continuously at an infinitely variable angular velocity, or it may be synchronized with the other motion components of the needle bar which is provided thereto by the first to third drives. A direction of rotation of the needle about its own axis is interesting, in case fiber interlaces are to be generated. When the needles penetrate into the fiber fleece they take fibers from a plurality of layers of the fleece through the rotation to interlace them with one another, thus causing a high stabilization also in case of thin fiber fleeces. The rotation may for instance be in the right direction during the stitching motion, and may be in the left direction during the return motion about a certain angle, wherein for instance the rotation of motion starts when the needles start penetrating into the fiber fleece web and the rotation of the needles stops in the lower dead center of the stitching motion, and the needles are rotated in backward direction upon the start of the return motion of the needle bar.

The control of the plurality of drive means is taken over by a control unit, by means of which the motions caused by the drives at the needle bars can be individually adjusted with regard to mutual phase position and possibly with regard to their amplitude. Synchronous operation of all corresponding drives of all needle bars can also be adjusted.

If successive needle bars stitch into opposite phase into the fiber fleece (phase shift 180°) it is favorable in order to avoid transport problems at the fleece web to shorten the phases in which the needles are stitched-in into the fleece web, so that time sections are generated in which no needles are stitched-in into the fleece web. As an alternative the advantages of the needle bar drive can be utilized, said needle bar drive being described in the above-mentioned U.S. Pat. No. 5,732,453, in order to overcome such transport problems.

A planar brush band or a lamellar grating may be used as a support for the fiber fleece web. In case of a very close spatial arrangement of the needle bars it is favorable to design the fleece support in a drum-like manner. For this purpose, a brush drum may be used or a drum with circumferential ribs with interposed circumferential grooves. A drum of that kind may in an advantageous manner be designed as a disk drum, composed of a plurality of disks having the same axes and mutual distance to each other, with at least some of the disks being driven in the fleece transport direction.

The fiber fleece web may be guided in a manner that partially surrounds one of the drums on its upper side and the adjoining drum on its lower side, so that adjoining drums are driven in directions opposite to each other. This embodiment is equal to a turning of the fiber fleece web with respect to the successive needling processes, i.e. it is successively needled from two different sides, which is required in many cases. It is, however, also possible to only guide the fiber fleece web over the upper side of all drums and to produce the partial surrounding by reversing drums which are arranged in the gussets between adjoining drums. In this case, all drums have corresponding directions of rotation.

A distortion of the fiber fleece web is avoided when it is actively driven by the fleece support, which is especially effective if for instance at least some of the disks of a disk drum have a circumferential toothing, which may be saw-tooth-like asymmetrical or also symmetrical. It is also possible to drive at least some of the driven disks with cyclically changing circumferential velocities in that an oscillating transport motion component is superimposed to a continuous transport component. A pilgrim-step operation of the fleece web forward feed is possible in accordance with the stitching phases in case of superposition of a horizontal motion component with respect to the needle bar according to U.S. Pat. No. 5,732,453 above.

If a plurality of disk drums are arranged in succession, it is possible to generate a fiber fleece expansion or upsetting caused by different circumferential velocities of the same.

The invention allows to mechanically compact a fiber fleece material or possibly to additionally provide it with pattern structures. The apparatus according to the invention complies with this aim in an excellent manner, since it allows to take the progress of the treatment of the fiber fleece web in the needling machine individual into account at each working position by means of individual adjustment of the needle bar movement, including the stitching depth.

This individual treatment alternative of the fiber fleece web also includes the individual selection of the types of needles. Various kinds of needles may be used: felt needles having notches of any design, so-called return needles, only active in backshaft, i.e. in the movement opposite to the stitching-in movement, needles having undefined notches, which only have a surface roughness, hook needles for locking stitches, crown needles and fork needles. The needles may be equal within a needle row and they may alternate. Needles notched in the forward direction may alternative with needles notched in backward direction. They may also be alternating and combined in any possible manner from needle bar to needle bar seen in the fleece progressing direction. The respective determination of the needle type and the equipment of the needle boards is determined by the person skilled in the art on the basis of the fiber fleece to be produced.

When using disk drums as a fleece support, different circumferential toothings may be chosen at one and the same drum. The toothing may be aligned in forward or backward direction or it may be symmetrical, depending on how the toothing shall differently influence by means of motion distraction the movability of the fibers in the longitudinal direction, diagonal or in the transverse direction so that the fiber orientation of the final product can amongst others also be influenced by the disk drums and their motion control.

The disks within one disk drum may all rotate at same speed or they may be rotated in a basic unidirectional speed to which an oscillating speed component is superimposed in a manner that within the drum the oscillating speed component of some disks is in anti-phase to the oscillating speed component of the other disks, so that deformations of the fleece are generated, which in turn change the fiber position during the stitch-in or stitch-out of the needles and thereby cause effects in view of appearance and strength values in the fleece plane.

Each individual needle or a needle pair of two needles arranged successively in the fleece transport direction may have an individual holding-down plate or two holding-down lamellae or disks which join the motion of the needle or the needle pair so that the fiber fleece web is not obstructed but basically only the stripper function is performed.

The individual velocities of rotation of the successively arranged disk drums is preferably controllable in an infinitely variable manner. The successive disk drum may have a higher circumferential velocity for performing a fleece deformation than the preceding disk drum. For the purpose of fleece upsetting or uncovering, the disk drum velocities could also be reduced in the fleece transport direction. The needling units acting at the adjoining disk drum as fleece support can be driven at different needle bar stroke frequencies and different phase settings, wherein an infinite adjustability is favorable. As an example for an interesting phase relation the needles of the first, third, fifth, i.e. odd needle bars could simultaneously penetrate into the fleece on a disk drum at the needling unit there, whereas the needles of the even interposed needle bars penetrate into the fiber fleece at a phase offset of 180°. Regarding the fleece transport, it is in this case referred to the above statements.

Instead of the motion component of the needle bar caused by the third drive means and extending transversely to the fleece transport direction and transversely to the stitching movement, a transverse movement of the stitch support could also be realized. This technically equivalent measure, which merely exchanges the kinematics, does not have to be described in detail in view of the above statements.

It is favorable that if a plurality of disk drums are used, these drums are arranged in a manner that the disks of a successive disk drum are offset axially with respect to the disks of the preceding disk drum about for instance half, a quarter, an eighth etc. pitch. Thereby a full transverse coverage of the fiber fleece web through the needle penetrations at the sum of needling units is achieved.

If the apparatus according to the advantageously described embodiment is equipped with rotatable needles, a certain space requirement exists for the mechanics of the needle rotation drive within a needle bar, said space requirement making the needle pitches greater than usually minimally possible. Thus, only few needle rows may exist at one single needle bar, for instance only three, two or even one needle row. This requires to provide a plurality of needle bars, since then the needles of the successive needle bars are offset with respect to each other, seen in the fleece transport direction. The plurality of needle bars does make it in turn possible to more favorably take the progressing processing of the fiber fleece into account than in case of the known needle machines. In order to obtain a compact stitching pattern, i.e. a close spacing of successive needle penetrations into the fiber fleece web, the use of a drum-like support is especially favorable, since it allows to arrange successive needle penetration points in the fleece at relatively narrow spacing despite the use of voluminous drives. A plurality of such closely arranged needle bars is comparable to a group of needle bars equipped with a plurality of needle rows of earlier machines and is controllable in common motion.

The use of a plurality of disk drums also makes it possible in a very simple manner to individually supply and needle together a plurality of fiber fleece webs, which possible have different structure, for instance different fiber orientations. This will be explained later with reference to an embodiment shown in the drawings.

SHORT DESCRIPTION OF THE DRAWINGS

The invention will now be described with reference to the drawings.

DESCRIPTION OF A PREFERRED EMBODIMENT

Figure 1:
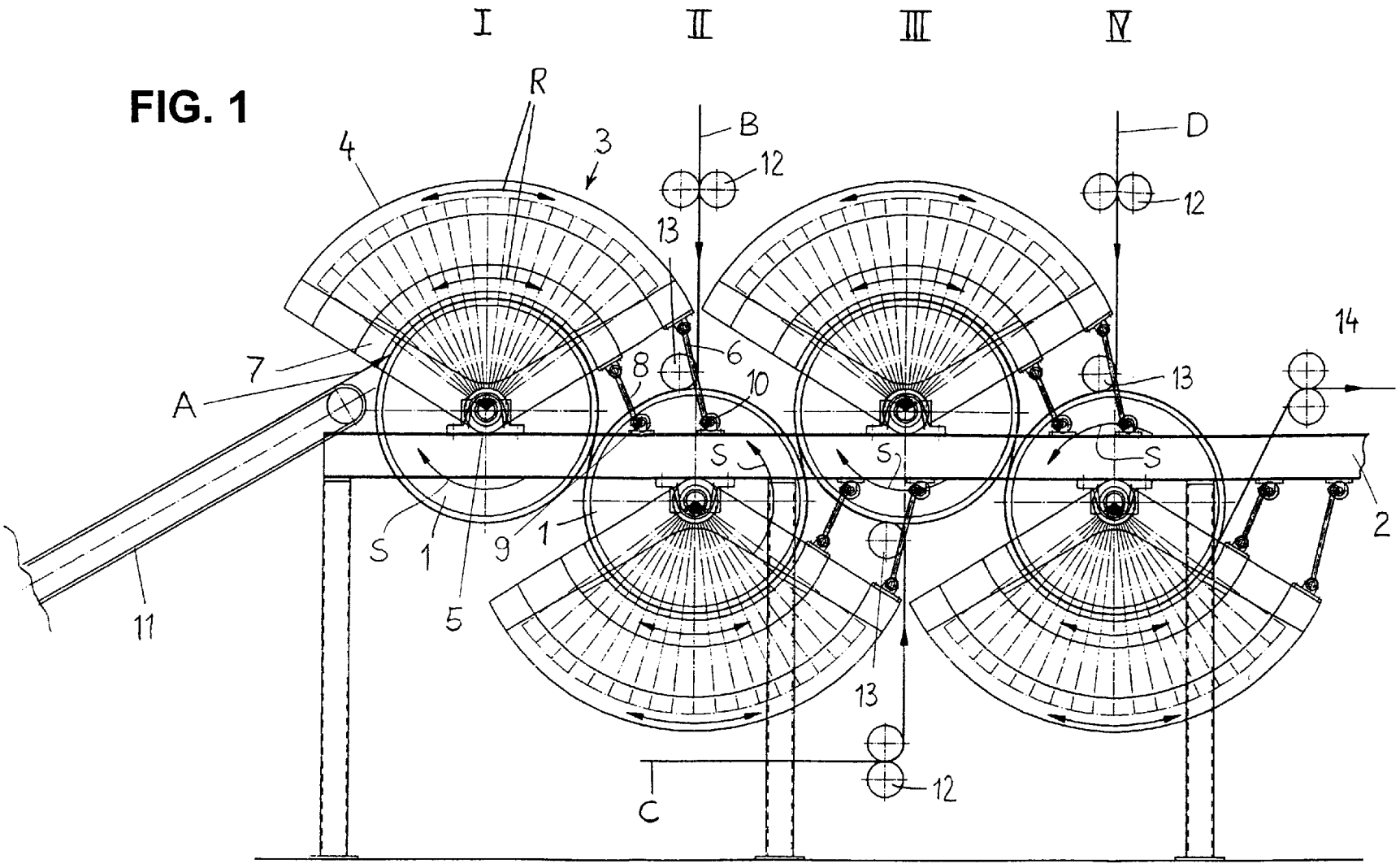
FIG. 1 is a schematic side view of the portion of an apparatus according to the invention which is necessary for explaining the invention.

FIG. 1 only shows the essential portion of a needling machine, said essential portion being addressed by the invention, namely the needling portion with a total of four needling zones I, II, III and IV. Each needling zone includes a disk drum 1 as fleece support rotatably supported in a stationary machine frame 2, and a needling unit 3 arranged at radial spacing to the disk drum 1. A fiber fleece web is successively guided over the upper side and the lower side of the successive disk drums 1.

Each needling unit 3 comprises an outer sector frame 4, which defines a circular sector, the axis of which coinciding with the axis 5 of the disk drum 1. The outer sector frame 4 is supported at the machine frame 2 via a first link arrangement 6. The drives of a plurality of needle bars are arranged at the outer sector frame 4, said needle bars being guided by an inner sector frame 7, which basically takes the same sector angle as the outer sector frame 4. The inner sector frame 7 is supported at the machine frame 2 by means of a second link arrangement 8.

The support of the second link arrangement 8 at the machine frame 1 is carried out in the example shown via a first eccentric arrangement 9, which can be rotated via a drive (not shown) so that the inner sector frame 7 may perform a reciprocating pivotal movement around the axis 5 of the disk drum 1. The support of the first link arrangement 6 at the machine frame 1 may be fixed, since the connection of the needle bar drives to the needle bar, as generally common, is carried out via connecting rods, which are therefore able to allow a restricted mutual offset of drive and needle bar caused by the pivotal movement of the inner sector frame 7. The support of the first link arrangement 6 can, however, be performed in a manner comparable to the second link arrangement 8 also via a driven, second eccentric arrangement 10, so that the outer sector frame 4 can follow the pivotal movement of the inner sector frame 7. These pivotal movements are indicated in the drawings by the double-sided arrows R.

In FIG. 1, a supply band 11 is shown next to the left-most disk drum 1, said supply band supplying a fiber fleece web A to be processed of the first needling zone I. This fiber fleece web A is processed in the first needling zone I and discharged by same in the direction towards the second needling zone II.

As can be seen in FIG. 1, the fiber fleece web processed in the first needling zone I may be doubled by a second fiber fleece web B before being supplied to the disk drum of the second needling zone II, said fiber fleece web B being supplied from the top via supply and reversing drums 12 and 13, respectively.

In the second needling zone the doubled fiber fleece webs A and B are needled together and are supplied from there to a third needling zone III, but before that they are doubled by a third fiber fleece web C supplied from below by another supply and reversing drum 12 and 13, respectively.

In the third needling zone III, the fiber fleece webs now consisting of three layers are needled and from there supplied to a fourth needling zone IV. Before laying it onto the disk drum of the fourth needling zone IV the three-layered, needled fiber fleece web is doubled by a fourth fiber fleece web D.

In the fourth needling zone IV the four-layered fiber fleece web is now needled and from there discharged via withdrawal drums 14.

It must be noted that the supply of a plurality of fiber fleece webs at different locations of the machine arrangement is only an example and must not be understood in a restrictive way. Only one single fiber fleece web for instance may be processed without any doubling, or fiber fleece webs supplied in a stacked manner can be supplied to the machine via the supply band 11, or the number of needling zones may deviate from the number shown in this example.

Furthermore, it should be mentioned that in the example shown the disk drums are driven in the transport direction of the fiber fleece web, which is characterized by arrows S.

In all four needling zones, the units necessary for needling may have the same design, they are, however, controlled according to the invention in a manner independent from one another by a central control unit (not shown) regarding their motion cycles.

It is, as described above, possible to couple either the inner sector frames 7 or the disk drums 1 with an individual drive (not shown), respectively, which causes axial movement. The stroke thereof must, however, be adapted to the gap width between the disk of the disk drum and eventually also with the pitch of the disks in a manner that a collision of the needles with the disks is excluded.

The drive means which put the needles to the stitch and return movement, are the above-mentioned first drive means. The means causing the pivotal motion of the inner sector frame 7 are the above-mentioned second drive means, and finally, the means causing the axial movement of either the needle bars or the disk drum are the above-mentioned third drive means.

Figure 2:
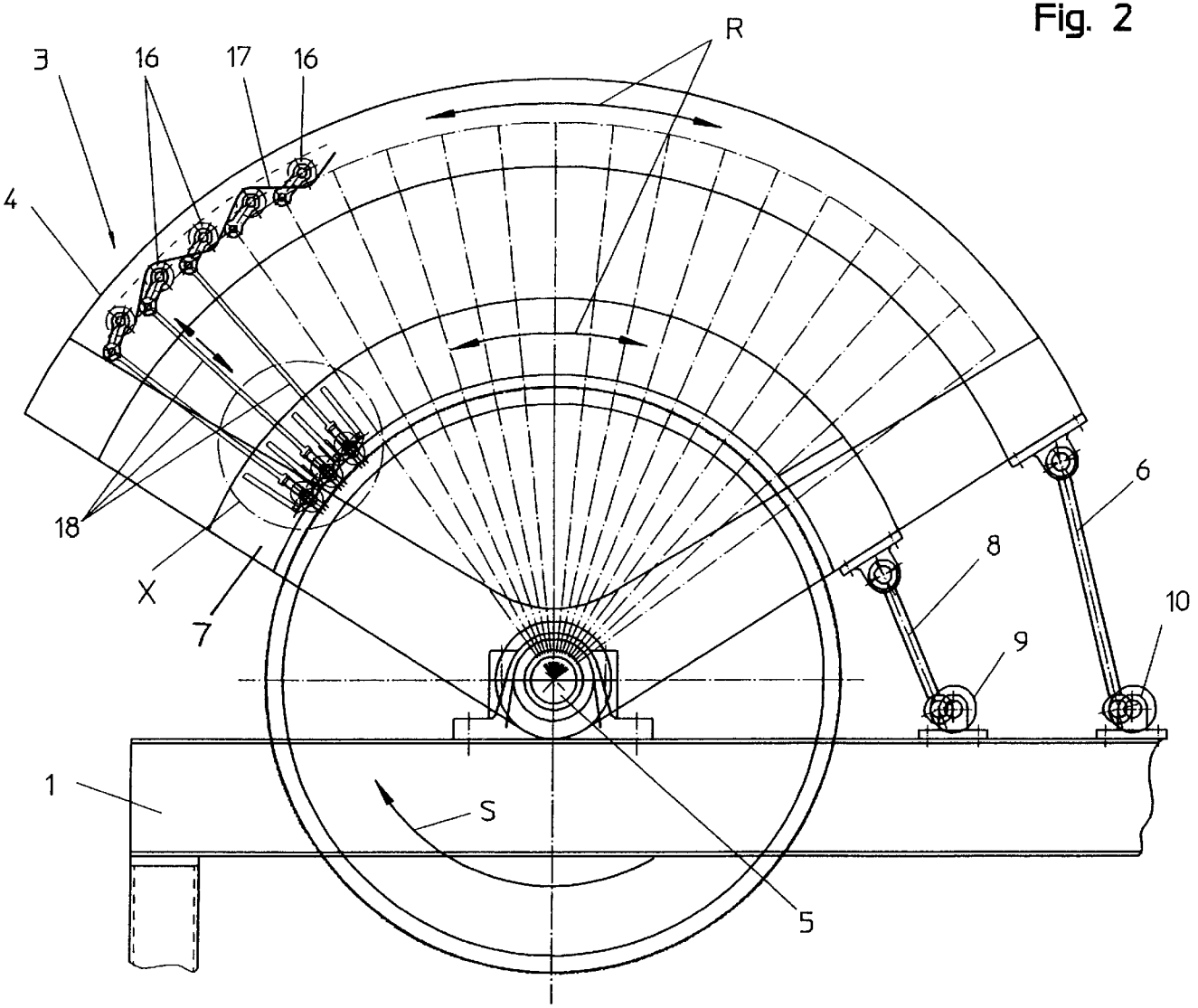
FIG. 2 shows a detail of FIG. 1 in enlarged scale.

FIG. 2 shows in a scale enlarged with respect to FIG. 1 a section of FIG. 1. It shows in addition to FIG. 1 a needling unit 3 composed of drive means 15 which form the above-mentioned first drive means and which are supported at the outer sector frame 4, and which are in this case shown as cam shafts 16 which are driven by a common driving belt 17. This driving belt 17 partially encompasses adjoining crank shafts 16 in an opposite direction so that they perform rotations opposite to each other which facilitates mass compensation.

Figure 3:
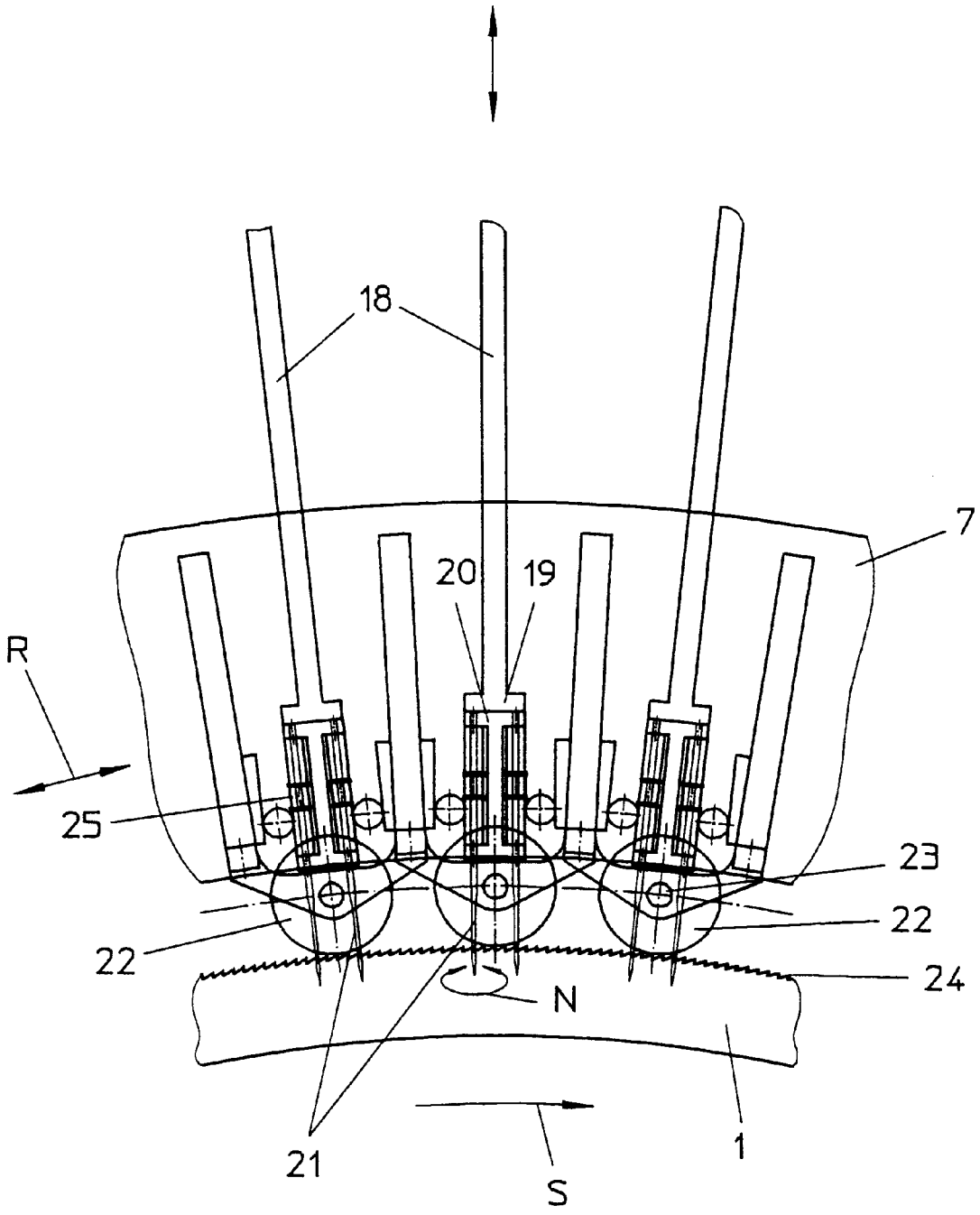
FIG. 3 shows a section of an enlarged schematic view of the needling zone as a detail of FIG. 2.

It is, however, also possible to drive the crank shafts in the same direction, e.g. via a belt guide adapted accordingly or via intermediate gears or the like. The crank shafts 16 are each connected to a respective needle bar 19 via a connecting rod 18. The entirety of needle bars 19 of the needling unit 3 is radially movably supported at the inner sector frame 7. Details are shown in FIG. 3. The drive for the drive belts 17 is not shown in FIG. 2 for reasons of simplicity.

In case the apparatus are multiplied appropriately, it is also conceivable to associate an individual drive to each individual needle bar. Then, it must be taken care that the stitching phases of the needles in the respective needling zone are matched in a manner that the transport of the fiber fleece web through the needling zone is not obstructed.

FIG. 3 shows as an enlarged section, the detail X of FIG. 2. The inner sector frame 7 can be seen which is kept at a distance with respect to the disk drum 1, with only the outer circumferential portion thereof being shown. The inner sector frame 7 holds a plurality of needle bars 19, with only three of them being shown in FIG. 3, and which are guided at the sector frame 7 radially displaceable towards the disk drum 1. A needle board 20 is attached at each needle bar 19, said needle board 20 carrying two rows of needles 21 that are parallel to each other, wherein two needles are arranged successively seen in transport direction of the fiber fleece web. In the example shown the needle bars 19 are rigidly connected to their associated connecting rods 18, which considerably simplifies the mechanic design, the connecting rods 18 could, however also be pivotally attached to the needle bars 19.

In the embodiment according to FIG. 3, the holding-down device, which at the same time fulfills the fiber stripper function, is formed by a plurality of disks 22, wherein at least one such disk 22 is arranged between two needle pairs. The disks 22 associated to a needle bar 19 are held in an axis 23 at the inner sector frame 7 and can be freely rotatable in order not to obstruct the transport of the fiber fleece web, they may, however, be driven to actively contribute to the transport of the fiber fleece web.

In the embodiment shown, the disk drum 1 has an asymmetric, saw-tooth like toothing 24 at its circumference, which promotes the transport of the fiber fleece web through the needling zone, in case of an appropriate drive of the disk drum, shown in the drawings by arrow S.

In the example shown, drive means 25 are arranged between the needle bar 19 and the needle boards 20, said drive means setting the needles 21 into rotation. These drive means 25 may be formed by cam guides, which engage the needles 21 rotatably supported in the needle boards 20, and which during the stitching motion of the needles 21 rotate same in the one direction and during the return motion of the needles 21 rotate same in the other direction about their axis. Different drive means are, however, also conceivable. The needle rotation in the two above-mentioned directions is indicated in FIG. 3 by the double-arrow N. These drive means 25 for the rotary motion of the needles represent the above-mentioned fourth drive means.

What is claimed is:

1. An apparatus for needling a fiber fleece web, comprising a fiber fleece support across which the fiber fleece web is moved by a transport means in a transport direction, a holding-down member arranged at a spacing over the fiber fleece support, said holding-down member having a plurality of needle penetration holes, a needling unit having at least two needle bars extending transversely to said transport direction and extending above the holding-down member and in parallel thereto and each carrying on a bottom side thereof a needle board equipped with a plurality of needles, and drive means setting the needle bars in a needle stitching-in and pulling-out motion directed perpendicularly to the fiber fleece support, wherein each needle bar comprises an individually associated drive means for the generation of the stitching motion, and further comprising control means by which the drive means of all needle bars can be controlled independently from one another.

2. An apparatus as claimed in claim 1, wherein at least some of the needle bars have associated thereto a second drive means which is connected to the respective needle bar and provides a reciprocating motion component thereto which is parallel to the fiber fleece web transport direction and is matched to the stitching-in motion of said needle bars.

3. An apparatus as claimed in claim 2, wherein all second drive means are connected to the control means and are independently controllable by this control means.

4. An apparatus as claimed in one of the preceding claims, wherein at least some of the needle bars have individually associated thereto a third drive means which is connected to one of the needle bar and the fiber fleece support and provides a reciprocating motion component thereto extending transversely to the fiber fleece web support direction and transversely to the needle stitching-in motion, said reciprocating motion component being matched to the needle stitching-in motion of the needle bar.

5. An apparatus as claimed in claim 4, wherein all third drive means are connected to the control means and are controllable independently of one another.

6. An apparatus as claimed in one of claims 1 to 3, wherein the fiber fleece support comprises an endless brush belt moving in the fiber fleece web transport direction.

7. An apparatus as claimed in claim 4, wherein the fiber fleece support comprises an endless brush belt moving in the fiber fleece web transport direction.

8. An apparatus as claimed in one of claims 1 to 3, wherein the fiber fleece support comprises a lamella grid with lamellae extending in the fiber fleece transport direction.

9. An apparatus as claimed in claim 4, wherein the fiber fleece support comprises a lamella grid with lamellae extending in the fiber fleece web transport direction.

10. An apparatus as claimed in one of claims 1 to 3, wherein the fiber fleece support is formed as a drum and the needle bars perform a stitching-in movement extending perpendicularly to an axis of said drum.

11. An apparatus as claimed in claim 4, wherein the fiber fleece support is formed as a drum and the needle bars perform a stitching-in movement extending perpendicularly to an axis of said drum.

12. An apparatus as claimed in claim 10, wherein the fiber fleece support comprises at least one drum driven in the fiber fleece web transport direction, said drum comprising a plurality of circumferential ribs separated from one another by circumferential grooves.

13. An apparatus as claimed in claim 11, wherein the fiber fleece support comprises at least one drum driven in the fiber fleece web transport direction, said drum comprising a plurality of circumferential ribs separated from one another by circumferential grooves.

14. An apparatus as claimed in claim 10, wherein the fiber fleece support comprises at least one drum which is composed of a plurality of co-axially arranged disks arranged in parallel at a mutual spacing, with at least some of the disks being driven in the fiber fleece web transport direction.

15. An apparatus as claimed in claim 11, wherein the fiber fleece support comprises at least one drum which is composed of a plurality of co-axially arranged disks arranged in parallel at a mutual spacing, with at least some of the disks being driven in the fiber fleece web transport direction.

16. An apparatus as claimed in claim 14, wherein the driven disks are provided with a circumferential toothing.

17. An apparatus as claimed in claim 15, wherein the driven disks are provided with a circumferential toothing.

18. An apparatus as claimed in claim 16, wherein the toothing is one of asymmetric in the manner of a saw-toothing and symmetric.

19. An apparatus as claimed in claim 17, wherein the toothing is one of asymmetric in the manner of saw-toothing and symmetric.

20. An apparatus as claimed in claim 14, wherein some of the driven disks perform a rotating movement having a velocity which is composed of a first, continuous transport velocity extending in the fiber fleece web transport direction and a second transport velocity having cyclically alternating directions and being superimposed to the first transport velocity.

21. An apparatus as claimed in claim 15, wherein some of the driven disks perform a rotating movement having a velocity which is composed of a first, continuous transport velocity extending in the fiber fleece web transport direction and a second transport velocity having cyclically alternating directions and being superimposed to the first transport velocity.

22. An apparatus as claimed in one of claims 1 to 3, wherein in at least some of the needle boards the needles are rotatably supported, and a controllable fourth drive means for rotating the needles is arranged at the needle bars carrying those needle boards, said fourth drive means being coupled to the rotatable needles.

23. An apparatus as claimed in claim 4, wherein in at least some of the needle boards the needles are rotatably supported, and a controllable fourth drive means for rotating the needles is arranged at the needle bars carrying those needle boards, said fourth drive means being coupled to the rotatable needles.

24. An apparatus as claimed in claim 22, wherein the fourth drive means are connected to the control means and are independently controllable by the control means.

25. An apparatus as claimed in claim 23, wherein the fourth drive means are connected to the control means and are independently controllable by said control means.

26. An apparatus as claimed in claim 24, wherein the control means is adapted to control each fourth drive means in accordance with the stitching-in motion of the respective needle bar.

27. An apparatus as claimed in claim 25, wherein the control means is adapted to control each fourth drive means in accordance with the stitching-in motion of the respective needle bar.

28. An apparatus as claimed in claim 24, wherein the fourth drive means are adapted to set the needles in a cyclically reciprocating rotation.

29. An apparatus as claimed in claim 25, wherein the fourth drive means are adapted to set the needles in a cyclically reciprocating rotation.

30. An apparatus as claimed in one of claims 1 to 3, wherein in at least some of adjoining needle bars the needle board at the one needle bar is equipped with needles having a type which is different of a type of needles of the needle board at the other needle bar.

31. An apparatus as claimed in claim 4, wherein in at least some of adjoining needle bars the needle board of the one needle bar is equipped with needles having a type which is different of a type of needles of the needle board at the other needle bar.

32. An apparatus as claimed in claim 30, wherein the needles at the one needle board are hook needles and that the needles at the adjoining needle board are return needles.

33. An apparatus as claimed in one of claims 1 to 3, wherein the needle bars each carry only few needle rows, preferably only one to three needle rows.

34. An apparatus as claimed in one of claims 1 to 3, wherein the fiber fleece support is composed of a plurality of drums arranged in parallel to one another and arranged successively in the fiber fleece web transport direction, said drums being partially encompassed by the fiber fleece web and being opposed by a needling unit comprising a plurality of independently driven needle bars.

35. An apparatus as claimed in claim 4, wherein the fiber fleece support is composed of a plurality of drums arranged in parallel to one another and arranged successively in the fiber fleece web transport direction, said drums being partially encompassed by the fiber fleece web and being opposed by a needling unit comprising a plurality of independently driven needle bars.

36. An apparatus as claimed in claim 34, wherein the drums are driven in opposite rotational directions and the fiber fleece web extends between the drums via intermediate drums which are arranged in gussets existing between the first-mentioned drums.

37. An apparatus as claimed in claim 35, wherein the drums are driven in opposite rotational directions and the fiber fleece web extends between the drums via intermediate drums which are arranged in gussets existing between the first-mentioned drums.

38. An apparatus as claimed in one of claims 1 to 3, in which one needle board carries two needle rows parallel to one another, wherein the holding-down member is formed by a plurality of disks, which are arranged on an axle extending in parallel to the longitudinal extension of the needle bar, wherein at least one disk is located between two needles which are adjoining transversely to the transport direction, and the disks are mounted at a carrier at which the needle bar is displaceably guided in a manner that the stitching motion is displaceable.

39. An apparatus as claimed in claim 4, in which one needle board carries two needle rows parallel to each other, wherein the holding-down member is formed by a plurality of disks, which are arranged on an axle extending in parallel to the longitudinal extension of the needle bar, wherein at least one disk is located between two needles which are adjoining transversely to the transport direction, and the disks are mounted at a carrier at which the needle bar is displaceably guided in a manner that the stitching motion is displaceable.

40. An apparatus as claimed in claim 38, wherein the holding-down disks of a plurality of needle boards are mounted at a common carrier at which all associated needle bars are displaceably guided.

41. An apparatus for needling a fiber fleece web, comprising a fiber fleece support across which the fiber fleece web is moved by a transport means in a transport direction, a holding-down member arranged at a spacing over the fiber fleece support, said holding-down member having a plurality of needle penetration holes, a needling unit having at least two needle bars extending transversely to said transport direction and extending above the holding-down member and in parallel thereto and each carrying on a bottom side thereof a needle board equipped with a plurality of needles, and drive means setting the needles bars in a needle stitching-in and pulling-out motion directed perpendicularly to the fiber fleece support, wherein a group of closely adjoining needle bars each carrying a few needle rows only and belonging to one of a plurality of needling zones comprises an individually associated drive means for the generation of the stitching motion, and further comprising control means by which the drive means of all needle bar groups can be controlled independently from one another.

42. An apparatus as claimed in claim 41, wherein at least some of the needle bar groups have associated a second drive means which is connected to the respective needle bars and provides them with a reciprocating motion component which is parallel to the fiber fleece web transport direction and is matched to the stitching-in motion of said needle bar group.

43. An apparatus as claimed in claim 42, wherein all second drive means are connected to the control means and are controllable independent from this control means.

44. An apparatus as claimed in one of claims 41 to 43, wherein at least some of the needling units have individually associated a third drive means which is connected to one of the needle bar group and the fiber fleece support and provides a reciprocating motion component thereto extending transversely to the fiber fleece web support direction and transversely to the needle stitching-in motion, said motion component being matched to the needle stitching-in motion of the needle bar group.

45. An apparatus as claimed in claim 44, wherein all third drive means are connected to the control means and are controllable independently of one another.

46. An apparatus as claimed in one of claims 41 to 43, wherein the fiber fleece support comprises an endless brush belt moving in the fiber fleece transport direction.

47. An apparatus as claimed in claims 44, wherein the fiber fleece support comprises an endless brush belt moving in the fiber fleece transport direction.

48. An apparatus as claimed in one of claims 41 to 43, wherein the fiber fleece support comprises a lamella grid with lamellae extending in the fiber fleece transport direction.

49. An apparatus as claimed in one of claims 41 to 43, wherein the fiber fleece support is formed as at least one drum, and that the needle bars perform a stitching-in movement extending perpendicularly to a drum axis.

50. An apparatus as claimed in claim 49, wherein the drum is driven in the fiber fleece web transport direction and comprises a plurality of circumferential ribs separated from one another by circumferential grooves.

51. An apparatus as claimed in claim 49, wherein the drum is composed of a plurality of co-axially arranged disks arranged in parallel at a mutual spacing, with at least some of the disks being driven in the fiber fleece web transport direction.

52. An apparatus as claimed in claim 51, wherein the driven disks are provided with a circumferential toothing.

53. An apparatus as claimed in claim 52, wherein the toothing is one of asymmetric in the manner of a saw-toothing and symmetric.

54. An apparatus as claimed in claim 51, wherein some of the driven disks perform a rotating movement having a velocity which is composed of a first, continuous transport velocity extending in the fiber fleece web transport direction and a second transport velocity having cyclically alternating directions and being superimposed to the first transport velocity.

55. An apparatus as claimed in one of the claims 41 to 43, wherein in at least some of the needle boards the needles are rotatably supported, and a controllable fourth drive means for rotating the needles is arranged at the needle bars carrying those needle boards, said fourth drive means being coupled to the rotatable needles.

56. An apparatus as claimed in claim 55, wherein the fourth drive means are connected to the control means and are independently controllable by the control means.

57. An apparatus as claimed in claim 56, wherein the control means is adapted to control each fourth drive means in accordance with the stitching-in motion of the respective needle bar.

58. An apparatus as claimed in claim 55, wherein the fourth drive means are adapted to set the needles in a cyclically reciprocating rotation.

59. An apparatus as claimed in one of claims 41 to 43, wherein in at least some of the adjoining needle bars the needle board of the one needle bar is equipped with needles having a type which is different of a type of needles of the needle board at the other needle bar.

60. An apparatus as claimed in claim 59, wherein the needles at the one needle board are hook needles and that the needles at the adjoining needle board are return needles.

61. An apparatus as claimed in one of claims 41 to 43, wherein the needle bars each carry only few needle rows, preferably only one to three needle rows.

62. An apparatus as claimed in one of claims 41 to 43, wherein the fiber fleece support is composed of a plurality of drums arranged in parallel to one another and arranged successively in the fiber fleece web transport direction, said drums being partially encompassed by the fiber fleece web, and being opposed by a needling unit comprising a plurality of independently driven needle bars.

63. An apparatus as claimed in claim 62, wherein the drums are driven in opposite directions and the fiber fleece web extends between the drums via intermediate drums which are arranged in gussets provided between the first-mentioned drums.

64. An apparatus as claimed in one of claims 41 to 43, in which one needle board carries two needle rows parallel to one another, wherein the holding-down member is formed by a plurality of disks, which are arranged on an axle extending in parallel to the longitudinal extension of the needle bar, wherein at least one disk is located between two needles which are adjoining transversely to the transport direction, and the disks are mounted at a carrier at which the needle bar is displaceably guided in a manner that the stitching motion is displaceable.

65. An apparatus as claimed in claim 64, wherein the holding-down disks of a plurality of needle boards are mounted at a common carrier at which all associated needle bars are displaceably guided.

* * * * *